US005266018A

United States Patent [19]

Niemiec

[11] Patent Number: 5,266,018

[45] Date of Patent: Nov. 30, 1993

[54] HYDRAULIC VANE PUMP WITH ENHANCED AXIAL PRESSURE BALANCE AND FLOW CHARACTERISTICS

[75] Inventor: Albin Niemiec, Sterling Heights, Mich.

[73] Assignee: Vickers, Incorporated, Troy, Mich.

[21] Appl. No.: 919,910

[22] Filed: Jul. 27, 1992

[51] Int. Cl.[5] ..... F03C 2/22; F04C 2/344

[52] U.S. Cl. ..... 418/82; 418/132; 418/133; 418/268

[58] Field of Search ..... 418/82, 132, 133, 267, 418/268

[56] References Cited

U.S. PATENT DOCUMENTS

| | | | |
|---|---|---|---|
| 2,842,064 | 7/1958 | Wahlmark | 418/133 |
| 3,265,006 | 8/1966 | Feroy | 418/82 |
| 3,578,888 | 5/1971 | Adams | 418/133 |
| 3,598,510 | 8/1971 | Aoki | 418/82 |
| 4,505,654 | 3/1985 | Dean, Jr. et al. | 418/133 |
| 4,913,636 | 4/1990 | Niemiec | 418/133 |

*Primary Examiner*—John J. Vrablik

*Attorney, Agent, or Firm*—Barnes, Kisselle, Raisch, Choate, Whittemore & Hulbert

[57] ABSTRACT

A rotary hydraulic device that includes a housing with support plates mounted against rotation. A pair of pressure plates are mounted on the support plates and cooperate with a surrounding cam ring to form a rotor cavity. A rotor is disposed for rotation with the rotor cavity, and has vanes that radially engage the surrounding surface of the cam ring. A circumferentially continuous hydrostatic pressure pool is formed between each pressure plate and its adjacent support plate for balancing and/or slightly exceeding the forces in the pump cavities that tend to separate the pressure plates. An isolated area within each hydrostatic pressure pool intermittently communicates with the pumping chambers through timing passages in the rotor. Fluid flowing to this isolated area may be employed to form a supplemental hydrostatic pressure pool for enhanced axial balance on the pressure plates, and/or for directing discharged flow through multistaged orifices to precompress the fluid volume to be displaced.

41 Claims, 9 Drawing Sheets

HYDRAULIC VANE PUMP WITH ENHANCED AXIAL PRESSURE BALANCE AND FLOW CHARACTERISTICS

The present invention is directed to rotary hydraulic devices capable of functioning as pumps, motors, flow dividers, pressure intensifiers and the like, and more particularly to a vane pump having enhanced pressure balance and flow characteristics.

BACKGROUND AND OBJECTS OF THE INVENTION

Rotary hydraulic devices of the subject type generally include a housing, a rotor mounted for rotation within the housing, and a plurality of vanes individually slidably disposed in corresponding radially extending peripheral slots in the rotor. A cam ring radially surrounds the rotor, and has an inwardly directed surface forming a vane track and one or more fluid pressure cavities between the cam surface and the rotor. Inlet and outlet passages in the housing feed hydraulic fluid to and from the fluid pressure cavity or cavities.

U.S. Pat. No. 4,505,654 discloses a balanced dual-lobe rotary vane pump in which the rotor cavity is formed by the cam ring and side support plates, with relatively thin pressure plates, also referred to as cheek plates, valve plates or flex plates, disposed between the support plates and the rotor. A pocket in each support plate is surrounded by seals that engages the pressure plate to form a hydrostatic pressure pool or pad between each support plate and its adjacent pressure plate. The outlet passages from the pump chambers extend through the pressure pools, so that the pressure pools are filled with fluid at substantially outlet pressure. The fluid pressure in the hydrostatic pools urges the pressure plates inwardly toward the rotor to balance or slightly exceed the forces of fluid pressure in the pumping chambers, and the pressure distribution of leakage fluid that flows between the rotor and pressure plates. Terminal hole vane slots in the rotor cooperate with each vane to form under-vane chambers at the axial outer ends of each vane and an intra-vane chamber at an intermediate section of each vane. Passages and grooves in the pressure plates and radial holes in the rotor segments feed fluid at inlet pressure to the under-vane chambers, and fluid at outlet pressure to the intra-vane chambers, for urging the vanes radially outwardly against the cam ring. The radial holes in the rotor segments communicate the pressure at the inter-vane volume to the terminal hole vane slots to reduce the radial thrust force of the vanes on the cam surface.

Although rotary vane pumps and other hydraulic devices of the subject type have enjoyed substantial commercial acceptance and success, further improvements remain desirable. For example, although provision of the hydrostatic pressure pools as disclosed in the above-noted U.S. patent improves fluid pressure balance as compared with previous art, the pools are disposed adjacent to the outlet sections of the pumping chambers, and thus do not provide pressure support on the pressure plate areas adjacent to the pump inlet sections. This lack of axial support permits localized outward deflection of the pressure plate and increased leakage of the displaced volume. Another problem arises due to the varying number of vane/rotor segments of the rotating group disposed within each pressure chamber. In a ten-vane pump, for example, the number of vane/rotor segments in each pumping chamber alternates in a sequence two-three-two-three, etc. as the rotor rotates. The hydrostatic pressure pools are designed to provide an average hydrostatic pressure force equivalent to the separating pressure force of 2.5 vane/rotor segments at pressure per displacement cycle. The axial balance on the pressure plates is sensitive to operating conditions affecting inlet pressure and diminished performance is noticed. Another problem in the art lies in the audible noise and erosive wear associated with outgassing of the dissolved air when the pressure fluid is subjected to throttling during the precompression of the fluid volume entering the displacement chamber. Metering grooves at the pressure plate ports in the prior art provide single stage throttling which produces considerable outgassing. With multistage orificing, the precompression flow contains considerably less outgassing, which result in quieter operation and reduced erosive wear.

It is therefore a general object of the present invention to provide a rotary hydraulic device, particularly a vane pump, that exhibits improved operational integrity, improved efficiency, reduced audible sound level, improved consistency of performance, reduced sensitivity to speed variations and/or reduced sensitivity to operation at sub-atmospheric pressure. Another and more specific object of the present invention is to provide a rotary hydraulic device of the described character that exhibits improved balance of fluid pressure forces on the pressure plates at all phases of operation. A further object of the present invention is to provide a rotary hydraulic device, particularly a vane pump, that satisfies one or more of the foregoing objectives while being economical to assemble and reliable over an extended operating lifetime.

SUMMARY OF THE INVENTION

A rotary hydraulic device in accordance with the present invention includes a housing having support plates mounted against rotation within the housing, and at least one pressure plate having an outer face opposed to a support plate. A rotor is mounted for rotation adjacent to the inner valve face of the pressure plate and has a plurality of vanes disposed in a corresponding plurality of vane slots. A cam ring is mounted within the housing radially surrounding the rotor, and has a radially inwardly directed surface forming a vane track and at least one fluid inlet cavity and one fluid discharge cavity between the cam ring surface and the rotor. Fluid inlet and outlet passages feed hydraulic fluid to and from the respective cavities. In the preferred balanced dual-lobe vane pump implementations of the invention herein disclosed, support plates and pressure plates are disposed on opposed sides of the rotor, and cooperate with the cam ring to form the rotor cavity. Identical arcuate fluid inlet and discharge cavities are formed on diametrically opposed sides of the rotor, and cooperate with diametrically opposed inlet passages and diametrically opposed outlet passages in the support and pressure plates for feeding fluid to and from the pumping cavities.

In accordance with a first aspect of the present invention, a hydrostatic pressure pool is formed between the outer face of each pressure plate and the opposing face of the adjacent support plate. These pressure pools, which are identical to each other, extend entirely around the axis of rotation of the rotor. The pressure pools are formed by pockets or depressions of uniform thickness in each of the support plates, and by circumferentially continuous seals on the support plates that engage the opposing outer pressure plate surface. The radial dimension of the pressure pools is smallest adjacent to the two cavity inlet passages where fluid pressure distribution is minimum within the pumping cavities, and is largest adjacent to the discharge outlet passages where fluid pressure distribution is greatest. In this way, enhanced axial hydrostatic pressure support on the pressure plates is achieved entirely around the axis of the rotating group. The hydrostatic forces on the pressure plates slightly exceed the separating hydraulic forces between the rotating rotor/vane group and the valve face of the pressure plates.

The single continuous pressure pool provides a more uniform hydrostatic force upon the pressure plate to balance and/or exceed the axial separating hydrostatic force of the pressure distribution on the inner valve face of the pressure plate. The volumetric pump efficiency is improved, and the contact of the rotating group on the valve face is light and uniform. Axial reliefs are provided on the inner area surfaces of the support plates to allow the pressure plates to deflect outward from the rotating group. The outward deflection accommodates mechanical forces induced by housing deflection and/or by thermal gradients within the pumping chambers. An outward deflection of the plate will reduce the magnitude of the internal pressure distribution, and the resulting net hydrostatic force will be significantly smaller than the constant hydrostatic pool. The difference in the hydrostatic force will restore the pressure plate to a reduced running clearance between the rotating group and the valve face. If the pressure plate deflects to reduce the running clearance excessively (approaching contact), the magnitude of the internal pressure distribution will create a hydrostatic force that exceeds the constant hydrostatic force of the pressure pool and the pressure plate will be deflected away from the rotating group. The deflective positions of the pressure plates are continuously adjusting to the pressure distribution on the valve faces. Consequently, the pump is less sensitive to external forces caused by large thermal gradients and the reactive support of pressure vessel containment (pump housing).

A second aspect of the present invention, which may be implemented either separately from or in combination with other aspects of the invention herein disclosed, addresses the problem of varying fluid pressure distribution within the pumping chamber as a function of the number of intervane chambers within the chambers. (The term intervane chamber is employed in its conventional sense to refer to the fluid chamber or volume between circumferentially adjacent vanes, and between the rotor periphery and the cam ring.) This number varies in the sequence N, N+1, N, N+1, etc., with N being a function of pump design and the total number of intervane chambers. For example, in the tenvane pump shown in U.S. Pat. No. 4,505,654, the number of intervane chambers subject to discharge pressure in each pumping chamber varies in the sequence 2,3,2,3, etc. as the rotating group rotates. In accordance with this aspect of the invention, improved dynamic pressure balance is obtained by a second or supplemental hydrostatic pressure pool formed within each first or primary pressure pool adjacent to the fluid outlet passages. Timing ports in the pressure plates cooperate with passages in the rotor for intermittently feeding fluid under pressure from the discharge port at the periphery of the rotor to the secondary or supplemental pressure pools, located in the support plates. Preferably, the passages in the rotor comprise a plurality of passages individually disposed between adjacent vanes.

In this way, the hydrostatic force exerted by the first and second pressure pools varies as a function of rotation of the rotor, and thus as a function of the number of intervane chambers in the pumping chambers. That is, the pressure plate ports that open to the secondary pressure pools and the passages in the rotor are so disposed that fluid under pressure is fed from the pumping chambers to the secondary pressure pools when three (N+1) intervane chambers are operatively disposed in each of the pumping chambers, and vent to inlet the secondary pressure pools when only two (N) intervane chambers are disposed in the pumping chambers. The primary pressure pools, which may be segmented or may be continuous in accordance with the first aspect of the invention discussed above, are designed to exert supporting pressure on the pressure plates when two (N) intervane chambers are disposed in pumping cavities, and the supplemental pressure pools are designed to exert supporting pressure on the pressure plates in an amount corresponding to the additional or third intervane chambers. At rated operating conditions, the hydrostatic force of the pressure pools balances or slightly exceeds the net hydrostatic force of the internal pressure distribution on the pressure plate. The resulting more uniform force distribution on the side plates reduces localized contact wear by the vane/rotor rotating group. The pump can better accommodate conditions that affect inlet pressure, such as high pump speeds, which reduces the magnitude of the pressure distribution at the rotating group. Volumetric efficiency is also improved.

In accordance with a third aspect of the present invention, which again may be implemented either separately from or in combination with other aspects of the invention, the isolated area within each hydrostatic pool provides a place for strategically locating a passage to utilize multistage orifices to throttle the discharged fluid flow to pre-compress the inter-vane volume to the discharge pressure level prior to its displacement in the outlet quadrant. The pre-compressive flow originates in the discharge chamber. The pressurized flow is conducted through the radial holes in the rotor and into the under-vane chambers which, upon registering, directs the flow into a strategically located pocket in the pressure plate. The flow enters the pocket that contains a sized orifice and continues in a passage located on the isolated area within the encompassing hydrostatic pool. The pre-compressive flow continues through a second orifice in the passage and passes through a third orifice located in the trailing pocket. Upon registering, the flow enters the trailing under-vane chambers and continues through the radial holes in the rotor to the inter-vane volume in the transition dwell between inlet and discharge. The inter-vane volume is pressurized to the discharge pressure level with a minimum amount of outgassing. In a conventional design, a metering groove is used to throttle the pressurized flow into the inter-vane volume for pre-compression. This single stage orifice produces a considerable amount outgassing that contributes to noise and the erosive wear with the pumping chambers. The multistage orifices of the present invention is essentially a series of sharp edge orifices installed in series. Its design prevents or reduces cavitation (out-gassing of the dissolved gas in fluids) by reducing pressure gradually rather than suddenly.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
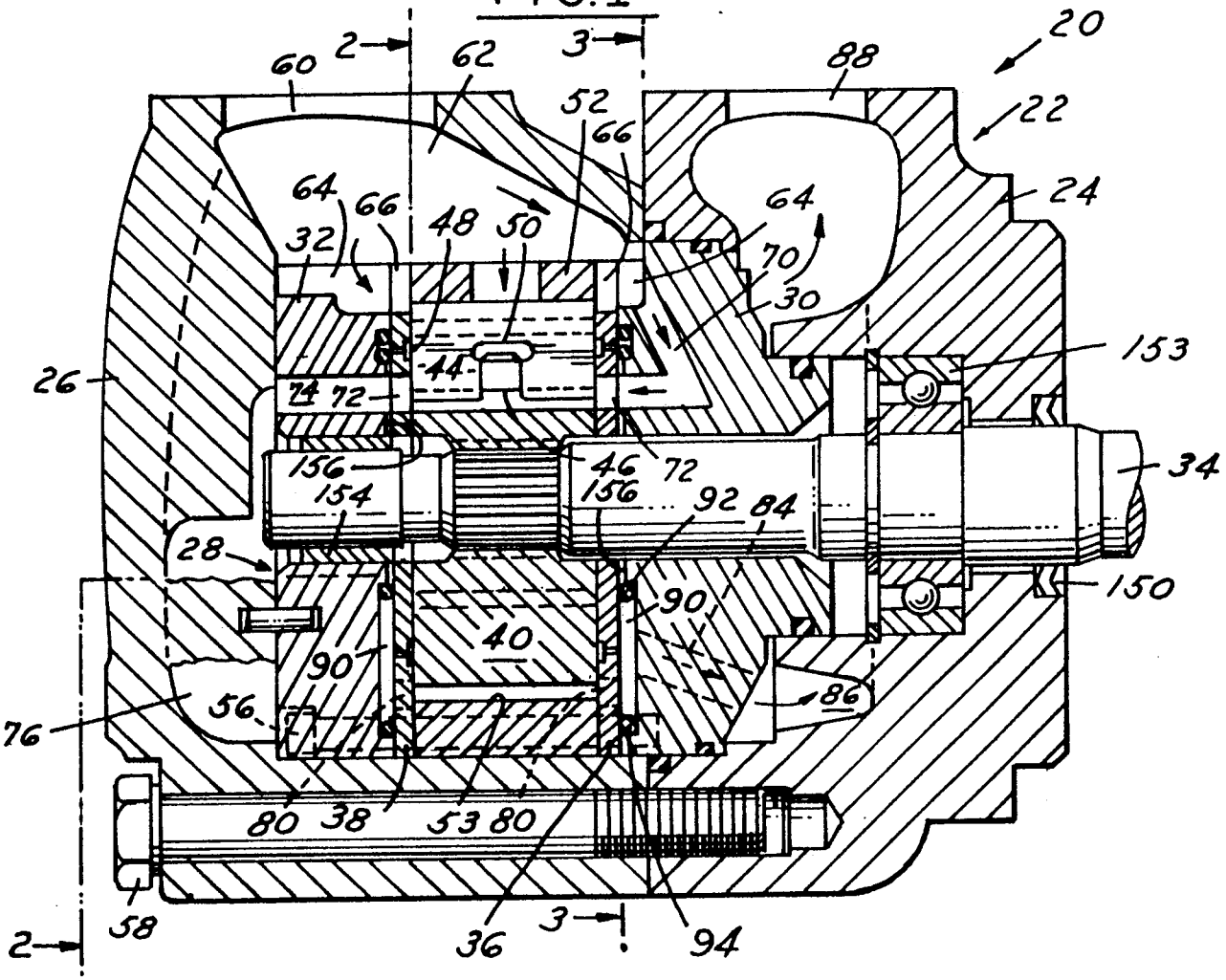
FIG. 1 is a sectional view in side elevation of a balanced dual-lobe rotary vane pump in accordance with one presently preferred implementation of the invention, being taken substantially along the line 1—1 in FIG. 2.
Figure 2:
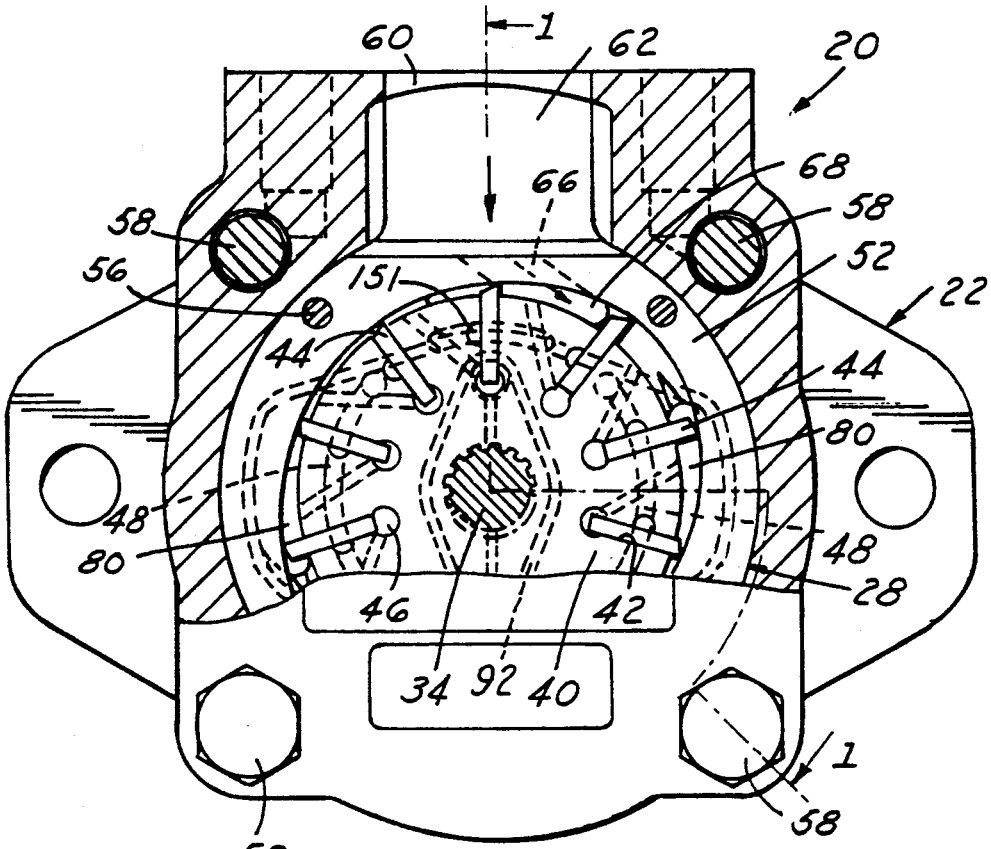
FIG. 2 is a fragmentary sectional view taken substantially along the line 2—2 in FIG. 1.
Figure 3:
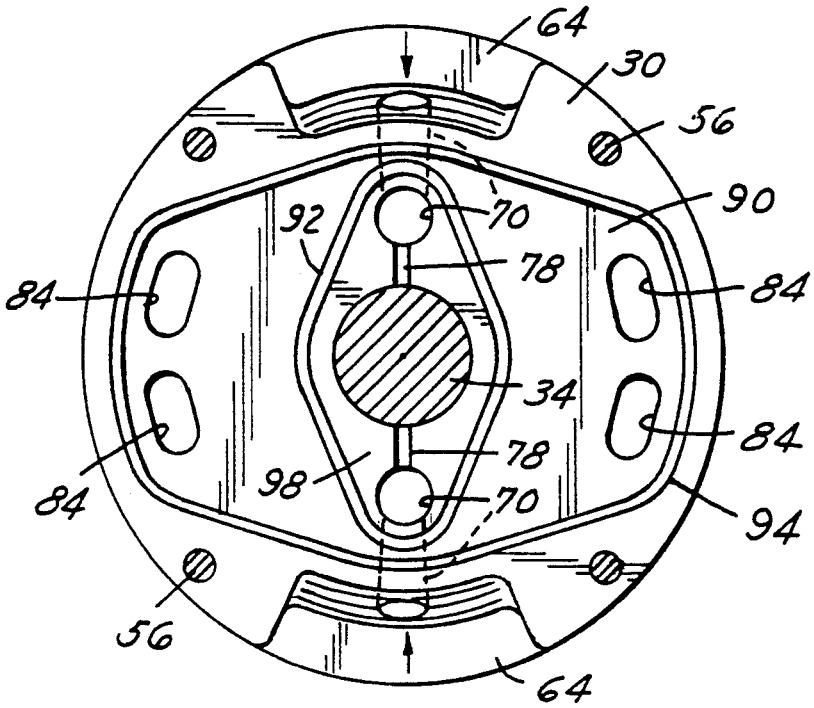
FIG. 3 is an elevational view of a support plate in the pump of FIG. 1, being taken substantially along the line 3—3 in FIG. 1.

FIGS. 1-3 illustrate a vane pump 20 in accordance with one presently preferred implementation of the invention as comprising a housing 22 having a body 24 and a cover 26. A vane pump sub-assembly or cartridge 28 is mounted between body 24 and cover 26. Cartridge 28 includes a first support member or plate 30 adjacent to body 24, and a second support member or plate 32 within cover 26. The support plates 30,32 have opposed faces spaced from each other in the direction of the axis of the pump drive shaft 34. A pressure plate 36 has an outer face adjacent and opposed to the support face of support plate 30, and a second pressure plate 38 has an outer face adjacent and opposed to the support face of plate 32. Pressure plates 36,38 are of substantially uniform thickness, and have axially opposed inner valve faces. As noted above, pressure plates 36,38 are also referred to as cheek plates, port plates and flex plates in the art. The pump timing is featured on the valve faces located on pressure plates, flex plates, etc.

A rotor 40 is disposed between the inner faces of pressure plates 36,38, and is rotatably coupled to splines on drive shaft 34. Rotor 40 has a plurality of generally radially extending slots 42, within each of which is disposed a radially slidable vane 44. The inner end of each vane slot 42 terminates in an under-vane chamber 46. A circumferential groove 48 located on each inner valve face of the pressure plates 36 and 38 is communicated with the discharge volume in pool 90, and supplies pressurized flow through axial passage 151 in each vane slot 42 to feed the intra-vane chamber 50 disposed about midway in the radial dimension of each vane 44. A cam ring 52 radially surrounds rotor 40, and has a radially inwardly oriented cam surface 53 that cooperates with rotor 40 to define diametrically opposed arcuate pumping events between the cam ring and rotor. The pump events consist of inlet, precompression, discharge, and decompression; this pumping cycle occurs twice per revolution. Cartridge 28 forms a sandwiched assembly held by a plurality of screws 56. The housing cover 26 and body 24 are fastened to each other by screws 58, which cartridge 28 captured therewithin.

Housing 22 has a fluid inlet 60 that opens into an inlet cavity 62 within cover 26, into inlet passages 64 in support plates 30,32 and through inlet passages 66 in pressure plates 36,38 to a kidney-shaped inlet port 68 in one of the expanding inter-vane chambers. Inlet passage 66 in support plate 30 also opens to a passage 70 within support plate 30, and thence through an opening 72 in plate 36, through the under-vane chamber 46 aligned therewith, and then through opening 72 in plate 38, passage 74 in support plate 32 and cavity 76 formed by cover 26 to a kidney-shaped inlet port 68 in the radially opposite expanding inter-vane chambers. Inlet fluid is thus fed to inter vane chambers, and to the common under-vane chambers 56.

The pressurized intra-vane chambers 50 provides the radial force to maintain vane 44 in contact with the cam surface in the inlet and in the precompression and decompression pumping cycles. Radial grooves 78 connected with inlet passages 70 and the area around shaft 34 are located to drain the pump leakage to prevent pressurization of the shaft seal 150. Within the pumping chamber, two axially opposed kidney-shaped outlet ports 80 in plates 36,38 are located to direct the discharge fluid into pool 90 and exhaust through passage 84 to opening 88 in housing body 24, as shown in FIG. 1. The diametrically opposite location of the ports 80 balances the radial forces on shaft 34 and the supporting bearings 153 and 154, as shown in FIGS. 1 and 2. To the extent thus far described, pump 20 is generally similar in both structure and operation to that disclosed in above-noted U.S. Pat. No. 4,505,654, to which reference may be made for detailed discussion.

In accordance with a first aspect of the present invention, a circumferentially continuous hydrostatic pressure pool 90 is formed between each support 30,32 and its adjacent associated pressure plate 36,38, each pool 90 being identical to the other and extending entirely around the axis of rotation of rotor 40 and shaft 34. Each pool 90 is formed by a first or inner resilient seal 92 that circumscribes shaft 34 and the open inner ends of passages 70 (as best seen in FIGS. 2 and 3), and a second or outer resilient seal 94 that circumscribes seal 92 and outlet openings 84. Seals 92,94 are compressed in assembly against the opposing outer faces of pressure plates 36,38. Thus, seals 92,94 cooperate with support plates 30,32 and pressure plates 36,38 to form hydrostatic pressure pools 90 on both sides of the pumping cavity. Pools 90 have a smaller radial dimension between the seals radially inward of inlet openings 64, and a larger radial dimension adjacent to and circumscribing outlet openings 84. The axial thickness of pools 90, determined by the depth of the pockets formed in plates 30,32, is substantially constant, except for the axial relief 156 shown in FIGS. 4 and 5. Since fluid at outlet pressure flows into each hydrostatic pressure pool, and indeed flows through the pool 90 between support 30 and plate 36, a hydrostatic clamping force is applied to the outer surface of pressure plates 36,38.

A circumferential groove 48 located on each inner valve face of pressure plates 36 and 38 is communicated with the discharge volume in pool 90, and supplies pressurized flow through axial passage 151 in each vane slot 42 to feed the intra-vane chamber 50 disposed about midway in the radial dimension of each vane 44, as shown in FIGS. 1 and 2. Within the pumping chamber, two axially opposed kidney-shaped outlet ports 80 formed in plates 36 and 38 are located to direct the discharge fluid into pool 90 and exhaust through passage 84 to opening 88 in the housing body 24 as shown in FIG. 1. A second set of ports 80 is located diametrically opposite to balance the radial forces upon the shaft 34 and supporting bearings 153 and 154, as shown in FIGS. 1 and 2.

Figure 4A:
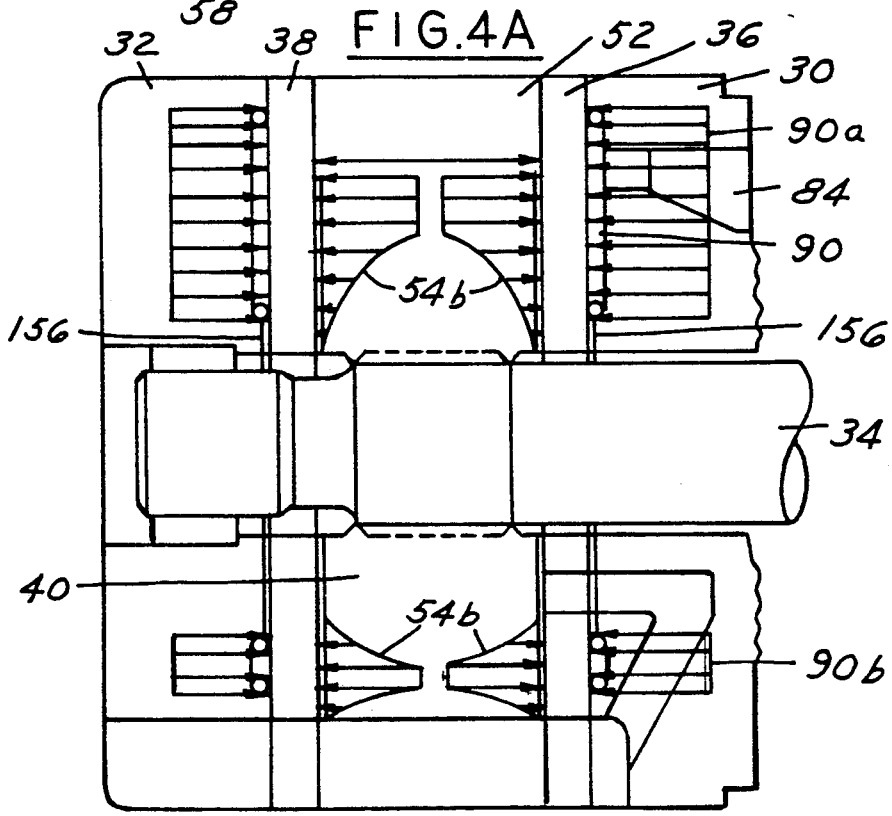
FIGS. 4, 4A and 5 are schematic diagrams that illustrate fluid forces on the pressure plates at differing operating conditions in the pump of FIGS. 1-3.
Figure 4:
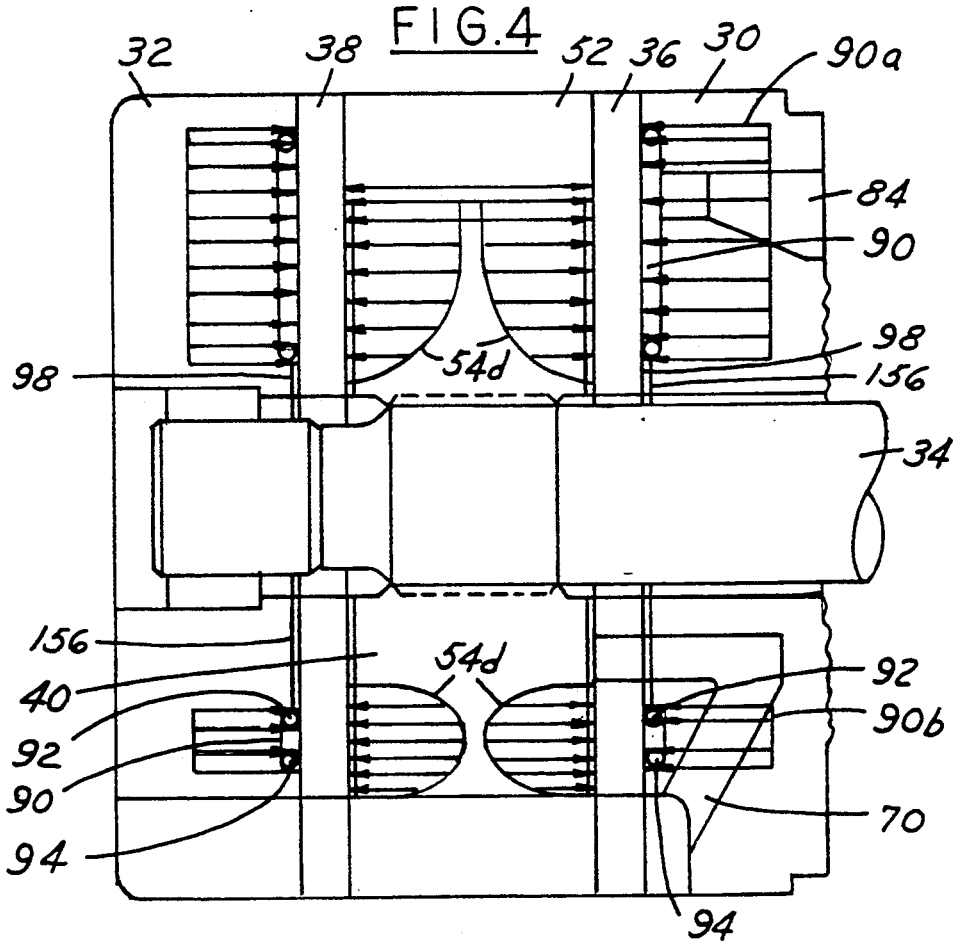
Figure 5:
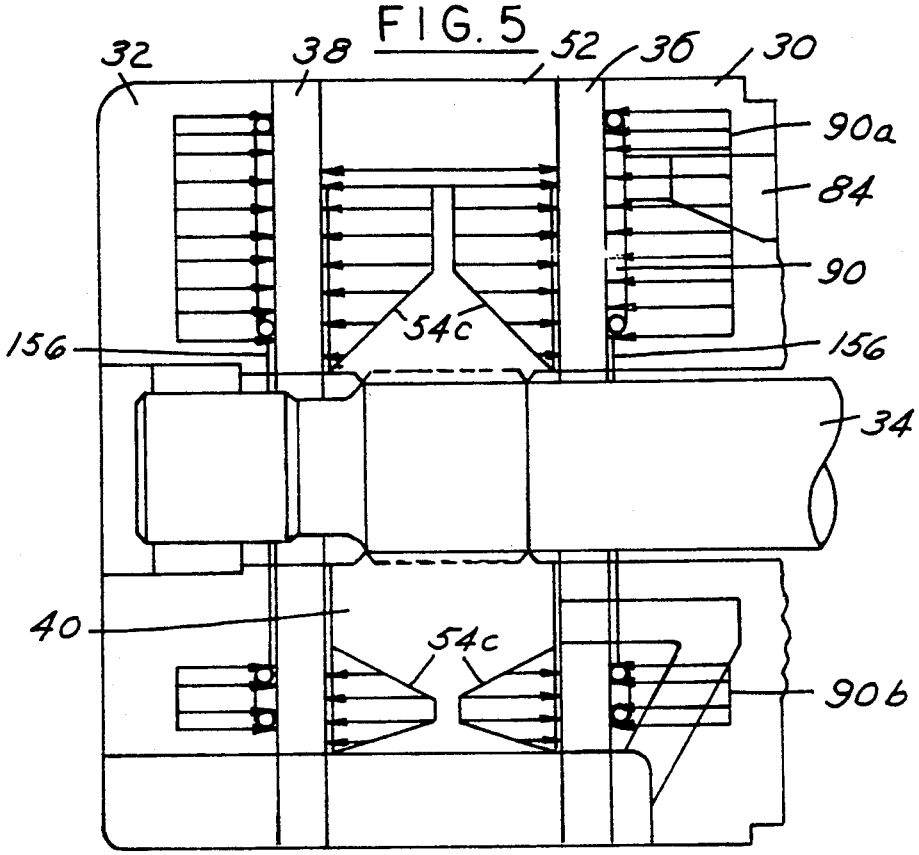
Figure 6:
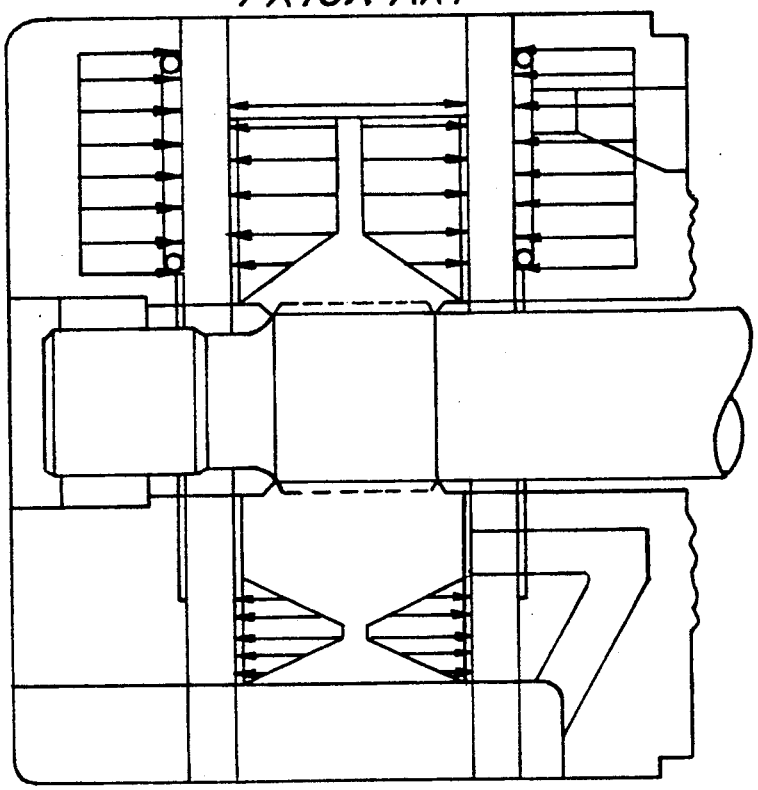
FIG. 6 PRIOR ART
FIG. 6 is a schematic diagram similar to those of FIGS. 4 and 5 but illustrating fluid forces on the pressure plates in accordance with the prior art.
Figure 7:
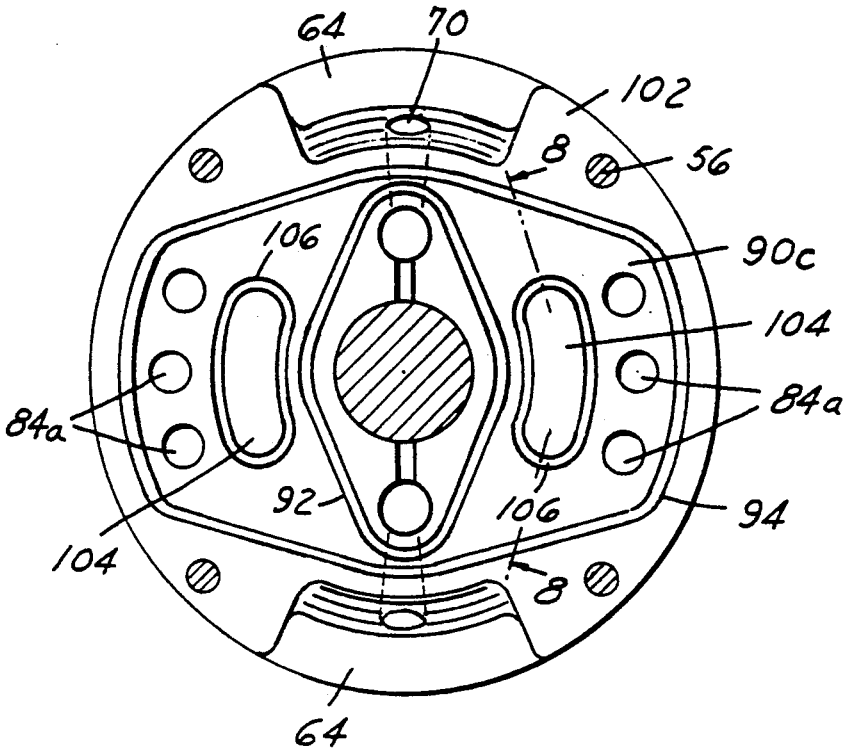
FIG. 7 is an elevational view of a support plate, similar to that of FIG. 3, but illustrating a modified embodiment of the invention.
Figure 15:
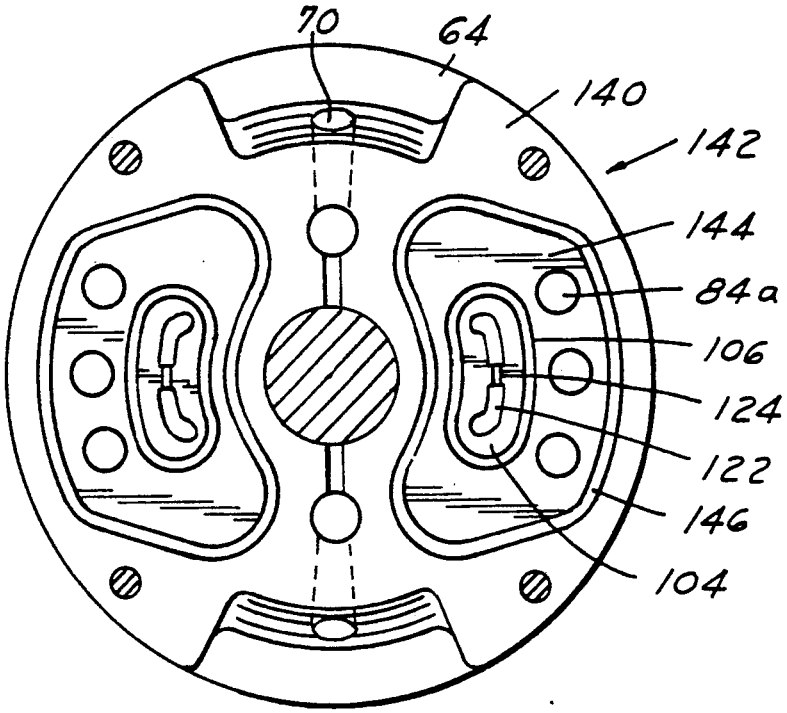
FIG. 15 is an elevational view of a support plate, similar to that of FIG. 3, but illustrating yet another modified embodiment of the invention.

FIGS. 4, 4A and 5 illustrate operation of the circumferentially continuous hydrostatic pressure pools 90 in accordance with this feature of the invention. The arrows in FIGS. 4, 4A, 5 and 6 schematically illustrate direction and magnitude of the fluid pressure distribution on the pressure plates. Adjacent to outlet openings 84, pools 90 are of largest radial dimension, and therefore exert the hydrostatic force 90*a* against the outer surfaces of the pressure plates 36,38 to oppose the pressure distribution within the pump chambers. It is also at this region adjacent to outlet openings 84 that the pressure distributions 54*a*,54*c* and 54*d* within the pumping chamber exerts the hydrostatic force against the inner faces tending to separate the pressure plates. On the other hand, adjacent to inlet passages 70, the pressure pools 90 are of smaller radial dimension and therefore exert a lesser hydrostatic force 90*b* against the outer pressure plate surface. It is also in this region that fluid pressure distributions within the pumping chambers are smaller. Therefore, the circumferentially continuous hydrostatic pressure pools 90 of the present invention provide enhanced pressure balance on the pressure plates, particularly adjacent to the inlet ports where there is no hydrostatic pool pressure support against the outer plate faces in the prior art, as shown in FIGS. 6 and 15.

FIGS. 4 and 5 illustrate the relatively uniform pressure distribution 54*c* between the rotating group and the valve face of the pressure plates. Variations on the structural containment of the pump cartridge and wide temperature gradients can warp the valve face of pressure plates 38 and 36. A change in the axial clearance between the rotating group and the valve face will affect pressure distribution 54*c*. A reduction in the axial clearance will restrict the leakage flow and increase the magnitude of pressure distribution 54*d* (FIG. 4). The net hydrostatic force will exceed the total hydrostatic force (90*a* plus 90*b*) of pool 90, and the pressure plate will deflect outward and avoid making contact with the rotating group. An axial relief 156 is defined by the difference in elevation between the area 98 around shaft 34 bounded by seal 92 and the outer periphery of each support plate 30, 32 clamped to the opposing pressure plate 36, 38. If the pressure plate deflects outward an excessive amount as permitted by axial relief 156, the pressure distribution will decay to resemble 54*b* in FIG. 4A, and a smaller hydrostatic force will oppose the total hydrostatic force (90*a* plus 90*b*) at pool 90. The force difference will restore the pressure plate to provide a smaller axial clearance at the rotating group. This balancing process will continue until an axial force equilibrium is achieved. The outcome of this pump design feature is improved volumetric efficiency, greater thermal shock capability and a lesser incident of rotating group seizures.

In FIGS. 7–15, which illustrate various modifications and variations in accordance with the present invention, reference numerals identical to those employed hereinabove in connection with pump 20 illustrated in FIGS. 1–5 indicate identical or equivalent components, and reference numerals with suffixes indicate related but modified components.

FIGS. 7–10 illustrate a pump 100 that features multiple area hydrostatic pools that are selectively ported to the pumping chambers through the rotor for more accurately supporting the axial hydrostatic separating and clamping forces imposed on the pressure plates. The separating pressure forces between the vane/rotor rotating group and the flexible pressure plates varies based upon the number of intervane chambers subject to discharge pressure within the pumping chambers. In a ten-vane rotating group, for example, the number of intervane chambers subject to discharge pressure per pumping chamber varies in the sequence two-three-two-three, etc. as the rotator rotates. In conventional vane pumps of the type disclosed in above-noted U.S. Pat. No. 4,505,654, and in the pump 20 hereinabove disclosed in connection with FIGS. 1–5, the hydrostatic pool area is designed to support an average of 2.5 intervane chambers at discharge pressure, thus being a compromise between the maximum of three segments and the minimum of two vanes per pumping cycle. However, in accordance with the embodiment of the invention illustrated in FIGS. 7–10, a separate and isolated area within each hydrostatic pool is sequentially ported to the discharge and to inlet through the rotor so as to apply hydrostatic pressure clamping forces to the pressure plates relative to the separating forces incurred with two and three intervane chambers subjected to discharge pressure. The main hydrostatic pool minus the two isolated areas is designed to equal or slightly exceed the hydrostatic separating force caused by the pressure distribution of two intervane chambers per discharge cycle at discharge pressure. The supplemental isolated pool areas are designed to become pressurized when three vane chamber rotor segments are at discharge pressure. At the latter operating conditions the hydrostatic force of the pool is equal or slightly exceeds the separating force.

Figure 9:
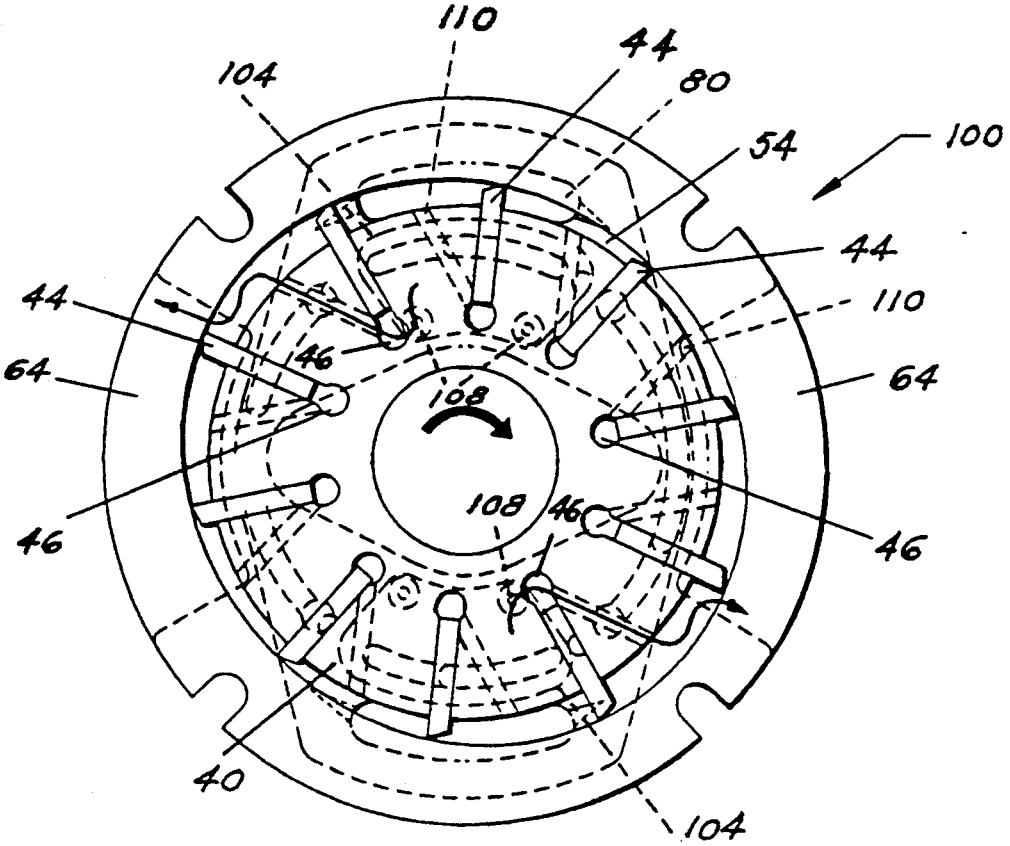
FIGS. 9 and 10 are fragmentary sectional views, similar to a portion of FIG. 2, but illustrating the modified embodiment of FIG. 8 at two stages of operation.
Figure 10:
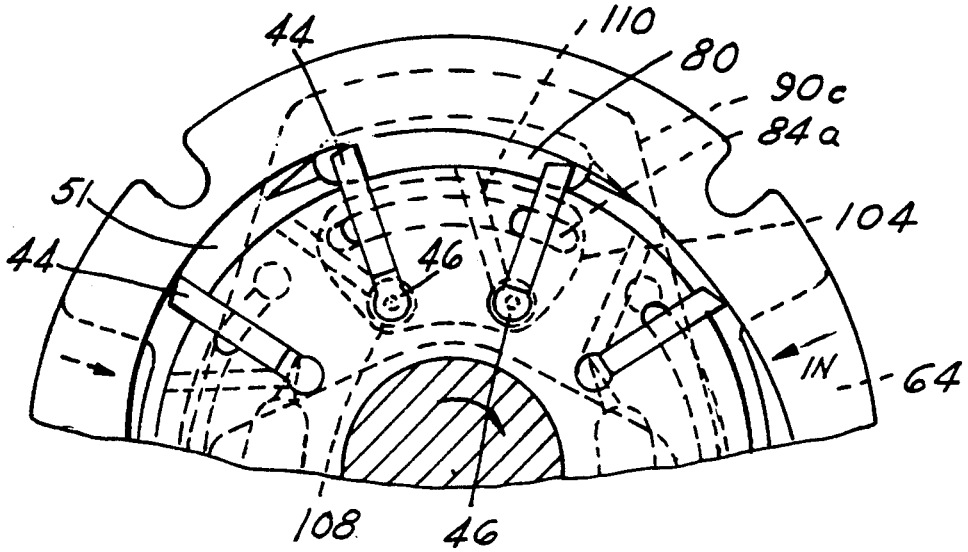
Figure 8:
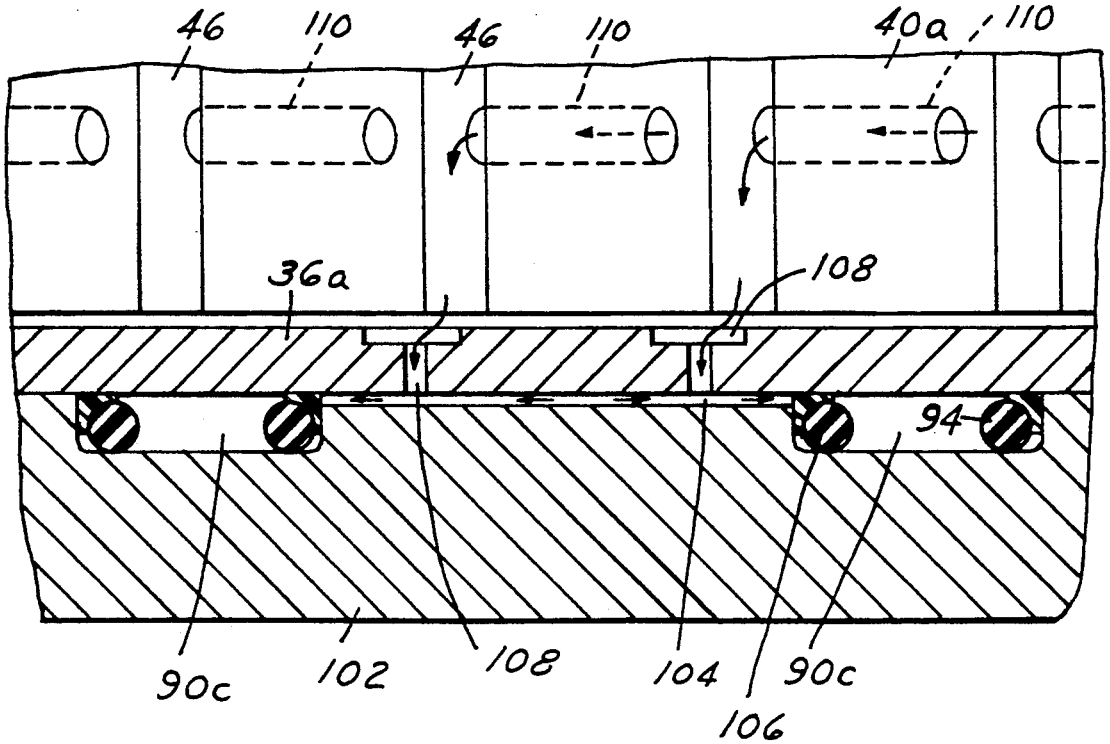
FIG. 8 is a fragmentary sectional view taken substantially along the line 8—8 in FIG. 7.

Referring to FIGS. 7–10, support plate 102 and the axially opposed support plate (not shown) has an isolated area 104 within each pressure pool 90*c* surrounded by a seal 106 that engages the outer face of the opposing pressure plate 36*a* (or 38*a*). As best seen in FIG. 8, the depression formed by the surface of support plate 102 is less in the isolated area 104 than in the main pressure pool 90*c*. Pressure plate 36*a* has axial passages 108 that open to area 104, and are positioned for axial alignment with under-vane chambers 46 in rotor 40*a* as the rotor rotates. Under-vane chambers 46 also communicate with the rotor periphery through radially angulated passages 110 in the rotor, thus communicating the pressure of the inter-vane volume. Passages 108 in plate 36*a* are so positioned as to register with under-vane chambers 46 when three intervane chambers in the adjacent pumping chamber 51 are at discharge pressure, as shown in FIG. 10, and to vent the pressurized area 104 to inlet pressure or port 64 when two intervane chambers are at discharge pressure as shown in FIG. 9. In this way, fluid at substantially discharge pressure is intermittently fed to area 104, as a function of rotor rotation, to provide extra clamping pressure at times that correspond to the presence of extra separating pressure due to a greater number of intervane chambers at discharge pressure. It will also be noted that fluid pressure in supplemental pool 104 increases as under-vane chambers 46 move into registry with passages 108, reaches a plateau at the point of full registration, and then decreases as the under-vane chambers move out of registration. Passages 108 are sized and located to synchronize the number of intervane chambers at pressure to the pressurization and venting of the isolated area within the hydrostatic pressure pool.

Figure 11:
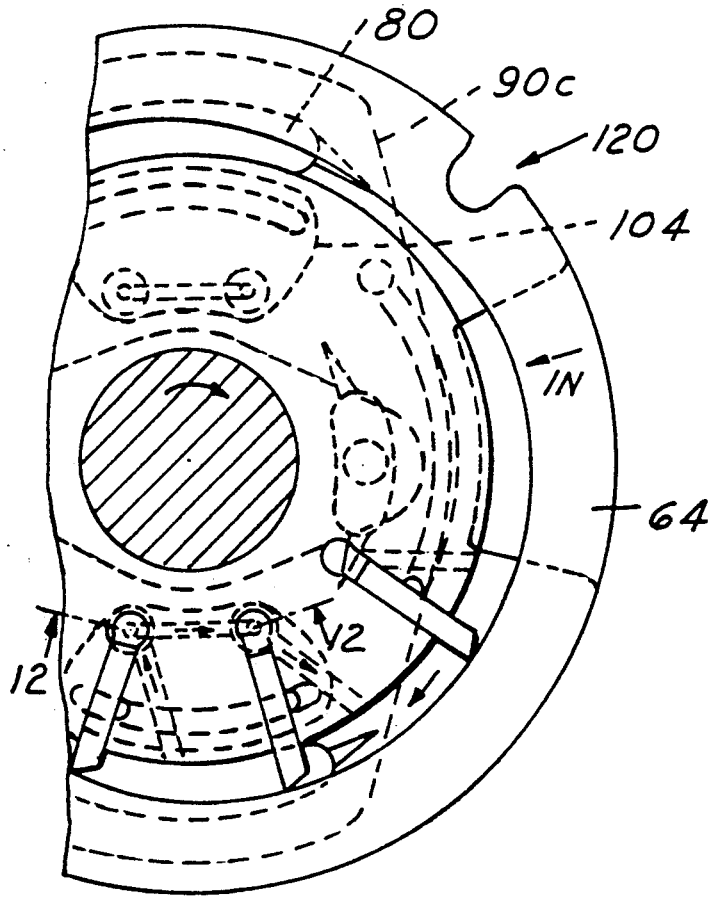
FIG. 11 is a fragmentary sectional view that illustrates another modified embodiment of the invention.
Figure 12:
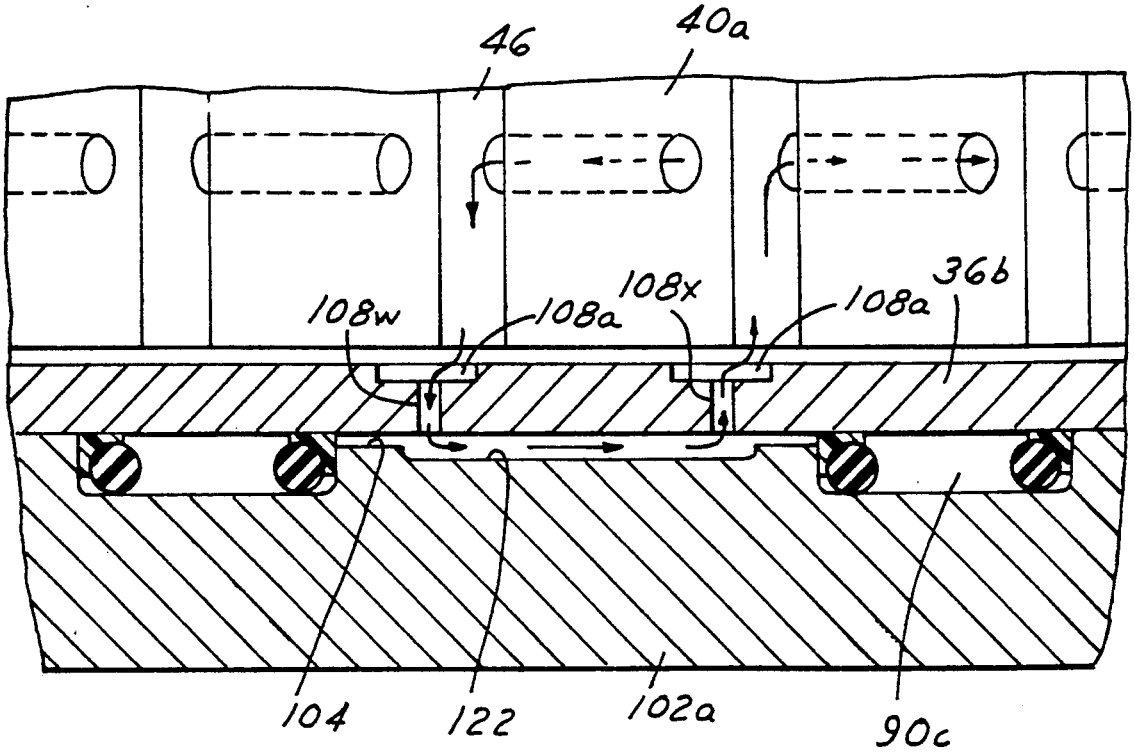
FIG. 12 is a fragmentary sectional view taken substantially along the line 12—12 in FIG. 11.
Figure 13:
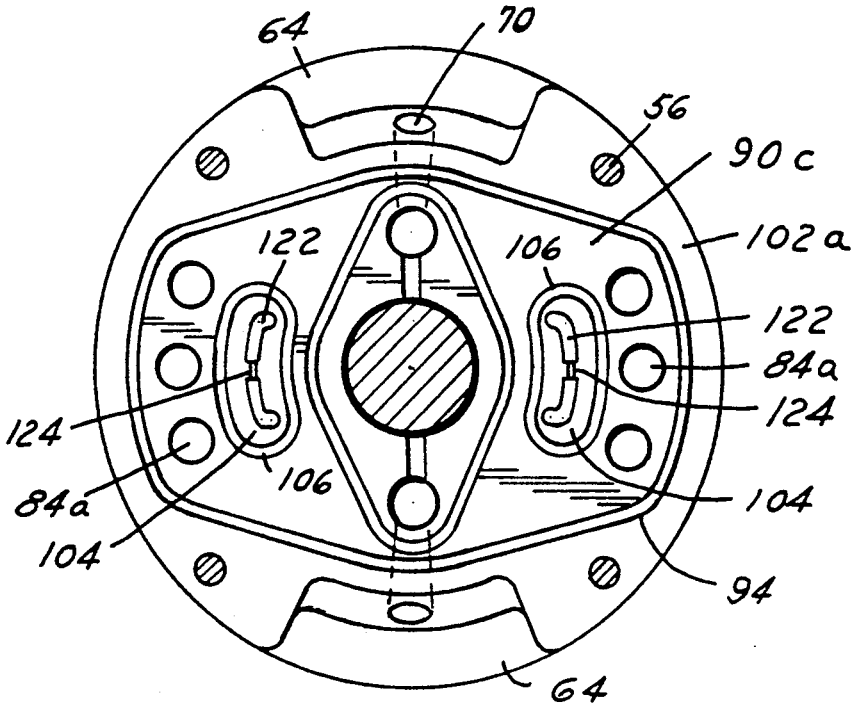
FIGS. 13 and 14 are elevational views of support plates, similar to that of FIG. 3, but illustrating respective additional modified embodiments of the invention.

FIGS. 11–13 illustrate a pump 120 in which the isolated secondary hydrostatic pressure pool area 104 within the primary hydrostatic pressure pool 90*c* is employed to locate multistage orifices for precompressing fluid in the inter-vane volume that is entering the discharge cycle, as well as for providing enhanced dynamic pressure balance on the pressure plates. These multistage orifices significantly reduce outgassing as compared with prior art pump constructions of single stage metering grooves, reducing or eliminating gas bubbles in the fluid, and thereby reducing audible noise and erosive wear associated with the gas bubbles. The passages 108*a* in pressure plate 36*b* are positioned for alignment with under-vane chambers 46 of rotor 40*a*, as in pump 100 (FIGS. 7–10). A channel or passage groove 122 in area 104 interconnects adjacent pressure plate passages 108*a*. Channel 122 directs the fluid flow, as illustrated by the directional arrows in FIGS. 11 and 12, between the intervane to precompress fluid in the intervane volumes to the discharge ,pressure prior to displacement during the discharge cycle. A series of orifices 108*w*, 124 and 108*x* in passages 108*a* (FIG. 12) and 124 in passages 122 (FIG. 13) are sized to stage the pressure reductions for precompressing the inter-vane volumes. This pressure staging reduces the amount of outgassing associated with throttling high pressure flow.

Figure 14:
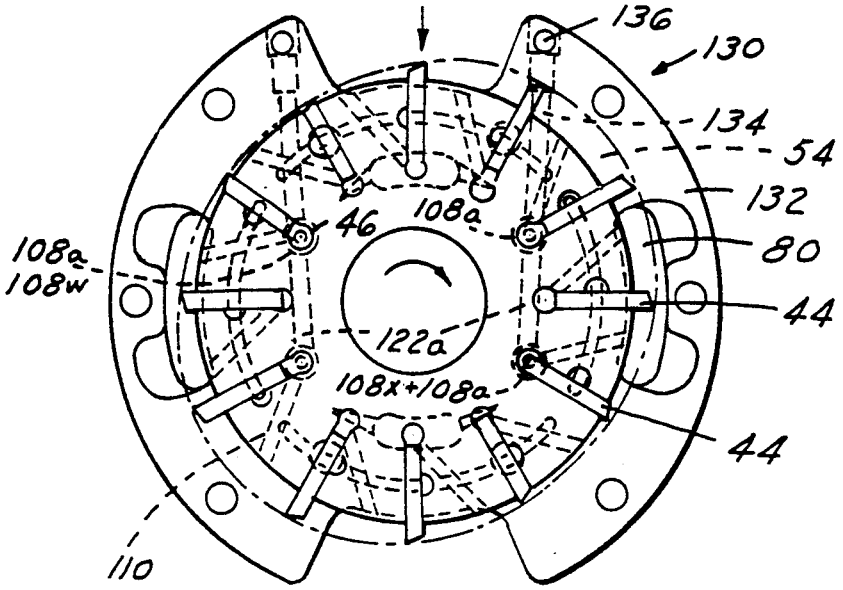

FIG. 14 illustrates a pump 130 in which the fluid precompression and outgassing reduction feature of the embodiments of FIGS. 11–13 are obtained in a pump having solid support plates 132, as distinguished from support plates with separate pressure plates as hereinabove described. Following casting and machining of the support plate 132, a hole 134 is drilled at an angle through the plate so as to interconnect the passages 108*a*, 108*w* 108*a*, 108*x* that open to the rotor under-vane chambers. The outer end of hole 134 is then plugged at 136, leaving a passage 122*a* that interconnects the passages 108*a*, 108*w*, 108*a*, 108*x* as in the embodiment of FIG. 12 in which passages 108 and passage 122 are formed in the separate pressure plate 36*b* and support plate 102*a* respectively.

FIG. 15 illustrates a support plate 140 of a pump 142 having isolated hydrostatic pressure pools 144 formed by seals 146 as in U.S. Pat. No. 4,505,654 noted above, as distinguished from the circumferentially continuous hydrostatic pressure pools 90,90*c* hereinabove described. A separate isolated area 104 is formed by the seal 106 within each pool 144. Passage channels 122 with restrictions 124 are formed in isolated areas 104, as hereinabove described in connection with FIG. 13. Thus, FIG. 15 illustrates that both the isolated hydrostatic pressure pool 104, and the fluid precompression feature provided by passage 122 and restriction 124, may be implemented in pumps having isolated primary pressure pools 144.

I claim:

1. A rotary hydraulic device that comprises:

a housing including support means mounted against rotation within said housing and having a support face, a pressure plate on said support means having an outer face opposed to said support face and an inner face, a rotor mounted for rotation adjacent to said inner face of said pressure plate, a plurality of slots and a plurality of vanes in said slots, a cam ring mounted within said housing radially surrounding said rotor and having a radially inwardly directed surface forming a vane track and at least one fluid pressure cavity between said surface and said rotor, a fluid inlet including inlet passage means for feeding fluid to said pressure cavity, a fluid outlet including outlet passage means for feeding fluid from said pressure cavity, and means forming a hydrostatic pressure pool between said outer pressure plate face and the opposing support face of said support means, said pressure pool extending entirely around the axis of rotation of said rotor, said pool being operatively coupled to said outlet passage means such that fluid in said pressure pool is at substantially outlet fluid pressure, said pressure pool having non-uniform radial dimension around said axis with a minimum radial dimension radially inward of said inlet passage means to said pressure cavity and a maximum radial dimension adjacent to said outlet passage means from said pressure cavity.

2. The device set forth in claim 1 wherein said means forming said hydrostatic pressure pool comprises a recess of substantially uniform thickness entirely around said axis of rotation.

3. The device set forth in claim 2 wherein said outlet passage means extends from said pressure cavity through said pressure pool.

4. The device set forth in claim 1 wherein said pressure pool has at least a portion of substantially uniform axial thickness entirely around said axis.

5. The device set forth in claim 1 wherein said means forming said pressure pool includes first means forming a first pressure pool extending entirely around said axis with means operatively connecting said first pool to said outlet passage means such that fluid in said first pool is continuously at substantially outlet pressure, and second means forming a second pressure pool and timing passage means intermittently operatively connecting said second pressure pool to said pressure cavity such that hydrostatic fluid pressure applied by said first and second pools to said pressure plate varies as a function of rotation of said rotor.

6. A rotary hydraulic device that comprises:

a housing including support means mounted against rotation within said housing and having a support face, a pressure plate on said support means having an outer face opposed to said support face and an inner face, a rotor mounted for rotation adjacent to said inner face of said pressure plate, a plurality of slots and a plurality of vanes in said slots, a cam ring mounted within said housing radially surrounding said rotor and having a radially inwardly directed surface forming a vane track and at least one fluid pressure cavity between said surface and said rotor, a fluid inlet including inlet passage means for feeding fluid to said pressure cavity, a fluid outlet including outlet passage means for feeding fluid from said pressure cavity, and means forming a hydrostatic pressure pool between said outer pressure plate face and the opposing support face of said support means, said pressure pool extending entirely around the axis of rotation of said rotor, said pool being operatively coupled to said outlet passage means such that fluid in said pressure pool is at substantially outlet fluid pressure, said means forming said pressure pool including first means forming a first pressure pool extending entirely around said axis with means operatively connecting said first pool to said outlet passage means such that fluid in said first pool is continuously at substantially outlet pressure, and second means forming a second pressure pool and timing passage means intermittently operatively connecting said second pressure pool to said pressure cavity such that hydrostatic fluid pressure applied by said first and second pools to said pressure plate varies as a function of rotation of said rotor.

7. The device set forth in claim 4 wherein said second pressure pool is radially surrounded by said first pressure pool.

8. The device set forth in claim 7 wherein said timing passage means extends through said rotor and said pressure plate.

9. The device set forth in claim 8 wherein said timing passage means includes first timing passage means extending through said rotor and opening adjacent to said pressure plate, and second timing passage means in said pressure plate disposed for intermittent alignment with said first timing passage means as said rotor rotates.

10. The device set forth in claim 9 wherein said first timing passage means in said rotor comprise a plurality of first timing passage means each disposed between an adjacent pair of vanes.

11. The device set forth in claim 10 wherein said timing passage means in said rotor and pressure plate are constructed and arranged such that fluid pressure at said second pool varies as a function of number of intervane chambers between said inlet passage means and said outlet passage means in said fluid pressure cavity.

12. The device set forth in claim 11 wherein said rotor and cam ring are constructed such that the number of intervane chambers in said fluid pressure cavity varies in the sequence, N, N+1, N, N+1, . . . where N is a non-zero integer, and wherein said timing passage means blocks fluid flow from said pressure cavity to said second pressure pool when N intervane chambers are in said pressure cavity and opens fluid flow from said pressure cavity to said second pressure pool when N+1 intervane chambers are in said pressure cavity.

13. The device set forth in claim 10 wherein said timing passage means in said rotor and pressure plate are constructed and arranged such that two adjacent intervane chambers in said pressure cavity communicate with said second pressure pool simultaneously.

14. The device set forth in claim 13 wherein said second means forming said second pressure pool comprises passage means interconnecting said timing passage means in said pressure plate such that fluid in one of said intervane chambers at higher pressure flows through said timing passage means and said pressure means in said second pressure pool to the other of said intervane chambers at lower pressure for precompressing fluid in said other chamber.

15. The device set forth in claim 14 wherein said passage means in said second pressure pool comprises an orifice.

16. The device set forth in claim 14 wherein multistage orifices are located in the timing passages and in the second pressure pool progressively to reduce the pressure and to reduce the outgassing and resulting cavitation.

17. A rotary hydraulic device that comprises:

a housing including support means mounted against rotation within said housing and having a support face, a pressure plate on said support ,means having an outer face opposed to said support face and an inner face, a rotor mounted for rotation adjacent to said inner face of said pressure plate, a plurality of slots and a plurality of vanes in said slots, a cam ring mounted within said housing radially surrounding said rotor and having a radially inwardly directed surface forming a vane track and at least one fluid pressure cavity between said surface and said rotor, a fluid inlet including inlet passage means for feeding fluid to said pressure cavity, a fluid outlet including outlet passage means for feeding fluid from said pressure cavity, and means forming a hydrostatic pressure pool between said outer pressure plate face and the opposing support face of said support means, said means forming said hydrostatic pressure pool including first means forming a first pressure pool with means connecting said first pool to said outlet passage means such that fluid in said first pool is continuously at substantially outlet pressure, and second means forming a second pressure pool and timing passage means intermittently operatively connecting said second pressure pool to said pressure cavity such that hydrostatic fluid pressure applied by said first and second pools to said pressure plate varies as a function of rotation of said rotor.

18. The device set forth in claim 16 wherein said timing passage means extends through said rotor and said pressure plate.

19. The device set forth in claim 18 wherein said timing passage means includes first timing passage means extending through said rotor and opening adjacent to said pressure plate, and second timing passage means in said pressure plate disposed for intermittent alignment with said first timing passage means as said rotor rotates.

20. The device set forth in claim 19 wherein said first timing passage means in said rotor comprises a plurality of first timing passage means each disposed between an adjacent pair of vanes.

21. The device set forth in claim 20 wherein said timing passage means in said rotor and pressure plate are constructed and arranged such that fluid pressure at said second pool varies as a function of number of intervane chambers between said inlet passage means and said outlet passage means in said fluid pressure cavity.

22. The device set forth in claim 21 wherein said rotor and cam rings are constructed such that the number of intervane chambers in said fluid pressure cavity varies in the sequence N, N+1, N, N+1 . . . where N is a non-zero integer, and wherein said timing passage means blocks fluid flow from said pressure cavity to said second pressure pool when N intervane chambers are in said pressure cavity and opens fluid from said pressure cavity to said second pressure pool when N+1 intervane chambers are in said pressure cavity.

23. The device set forth in claim 19 wherein said second pressure pool is radially surrounded by said first pressure pool.

24. The device set forth in claim 23 wherein said first pressure pool extends entirely around the axis of rotation of said rotor.

25. The device set forth in claim 24 wherein said first pressure pool is of non-uniform radial dimension around said axis, having a minimum radial dimension radially inner of said inlet passage means to said pressure cavity and a maximum radial dimension adjacent to said outlet passage means from said pressure cavity, said second pressure pool being disposed in a portion of said first pool of said maximum dimension.

26. The device set forth in claim 19 wherein said timing passage means in said rotor and pressure plate are constructed and arranged such that two adjacent intervane chambers in said pressure cavity communicate with said second pressure pool simultaneously.

27. The device set forth in claim 26 wherein said second means forming said second pressure pool comprises passage means interconnecting said timing passage means in said pressure plate such that fluid in one of said intervane chambers at higher pressure flows through said timing passage means and said passage means in said second pressure pool to the other of said intervane chambers at lower pressure for precompressing fluid in said other chamber.

28. The device set forth in claim 27 said passage means in said second pressure pool comprises an orifice.

29. The device set forth in claim 27 wherein multistage orifices are located in the timing passages and in the second pressure pool progressively to reduce the pressure and to reduce the outgassing and resulting cavitation.

30. A rotary hydraulic device that comprises:

a housing including support means mounted against rotation within said housing and having a support face, a plate on said support means having an outer face opposed to said support face and an inner face, a rotor mounted for rotation adjacent to said inner face of said pressure plate, a plurality of slots and a plurality of vanes in said slots, a cam ring mounted within said housing radially surrounding said rotor and having a radially inwardly directed surface forming a vane track and at least one fluid pressure cavity between said surface and said rotor, a fluid inlet including inlet passage means for feeding fluid to said pressure cavity, a fluid outlet including outlet passage means for feeding fluid from said pressure cavity, and sealing means between said support face and said outer face forming a fluid pool, and timing passage means in said rotor and said pressure plate intermittently connecting said pressure cavity to said fluid pool as a function of rotation of said rotor.

31. The device set forth in claim 30 wherein said timing passage means in said rotor includes a plurality of passage means opening between adjacent vanes at the periphery of said rotor.

32. The device set forth in claim 31 wherein said timing passage means in said rotor and pressure plate are constructed and arranged such that fluid pressure at said pool varies as a function of number of intervane chambers between said inlet passage means and said outlet passage means in said fluid pressure cavity.

33. The device set forth in claim 32 wherein said rotor and cam ring are constructed such that the number of intervane chambers in said fluid pressure cavity varies in the sequence N, N+1, N, N+1 . . . where N is a non-zero integer, and wherein said timing passage means blocks fluid flow from said pressure cavity to said pressure pool when N intervane chambers are in said pressure cavity and opens fluid flow from said pressure cavity to said pressure pool when N+1 intervane chambers are in said pressure cavity.

34. The device set forth in claim 30 wherein said timing passage means in said rotor and pressure plate are constructed and arranged such that two adjacent intervane chambers in said pressure cavity communicate with said pressure pool simultaneously.

35. The device set forth in claim 34 wherein said means forming said pressure pool comprises passage means interconnecting said timing passage means in said pressure plate such that fluid in one of said intervane chambers at higher pressure flows through said timing passage means and said passage means in said pressure pool to the other of said intervane chambers at lower pressure for precompressing fluid in said other chamber.

36. The device set forth in claim 35 wherein said passage means in said pressure pool comprises an orifice.

37. A rotary hydraulic device that comprises:

a housing including support means mounted against rotation within said housing and having a support face, a rotor mounted for rotation adjacent to said support face, a plurality of slots and a plurality of vanes in said slots, a cam ring mounted within said housing radially surrounding said rotor and having a radially inwardly directed surface forming a vane track and at least one fluid pressure cavity between said surface and said rotor, a fluid inlet including inlet passage means for feeding fluid to said pressure cavity, a fluid outlet including outlet passage means for feeding fluid from said pressure cavity, and timing passage means in said rotor and said support means intermittently connecting adjacent intervane chambers in said pressure cavity such that fluid in one of said intervane chambers at higher pressure flows through said timing passage means to the other of said intervane chambers at lower pressure for precompressing fluid in said other chamber, said support means including a plate on said support means having an outer face opposed to said support face, and sealing means between said support face and said outer face forming a fluid pool, said timing passage means in said rotor and said support means intermittently connecting said pressure cavity to said fluid pool as a function of rotation of said rotor.

38. The device set forth in claim 37 wherein said timing passage means in said rotor includes a plurality of passage means opening between adjacent vanes at the periphery of said rotor.

39. The device set forth in claim 37 wherein said timing passage means in said comprises an orifice.

40. The device set forth in claim 37 wherein multistage orifices are located in the timing passage means progressively to reduce the pressure and to reduce the outgassing and resulting cavitation.

41. A rotary hydraulic device that comprises:

a housing for axially and radially locating a vane pump cartridge, for providing an anti-rotational feature, and for including fluid inlet and discharge ports, a bearing-supported shaft for driving a pump rotating group, a shaft seal for containing fluid drainage within the housing, the vane pump cartridge comprising two sets of support plates and flexible side plates, each set being located on one side of a cam ring, a radially slotted rotor with vanes located within the cam ring and enclosed by said two sets of support plates and flexible side plates, the two sets of support plates and flexible side plates containing inlet and discharge port passages, each support plate including a hydrostatic pool between the support plate and the adjacent flexible side plate, the size and shape of the hydrostatic pool being based upon pressure distribution between the flexible side plate and the rotating group, the hydrostatic pressure force of the pool being at least equal to or slightly larger than the separating hydrostatic force of the pressure distribution on the valve face of the flexible side plate facing the rotary group, the height of the inner support surface of the pool around the shaft being slightly lower than the support area at the periphery of the support plates to permit the flexible side plate to deflect away from the rotating group, the radial surfaces of the pool having contoured elastomers and reinforcements to define and seal the pool area, a raised and isolated island located within the pool in the vicinity of each discharge port, pressure sensing passages in each flexible side plate located to an associated isolated island to drain this area to inlet when two intervane chambers are at discharge pressure and to pressurize, this area to discharge pressure when three intervane chambers are at discharge pressure, synchronization for controlling and for balancing the opposing axial hydrostatic forces on the flexible side plates being performed by intermittent registration of porting in the rotor with timing ports on the valve face of the flexible side plates.

* * * * *